US006312083B1

(12) United States Patent
Moore

(10) Patent No.: US 6,312,083 B1
(45) Date of Patent: Nov. 6, 2001

(54) PRINTHEAD ASSEMBLY WITH INK MONITORING SYSTEM

(75) Inventor: Steven R. Moore, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/467,614

(22) Filed: Dec. 20, 1999

(51) Int. Cl.[7] ..... B41J 29/393
(52) U.S. Cl. ..... 347/19
(58) Field of Search ..... 347/7, 19, 23; 399/13; 116/200, 201, 202

(56) References Cited

U.S. PATENT DOCUMENTS

| | | | | |
|---|---|---|---|---|
| Re. 32,572 | | 1/1988 | Hawkins et al. | 156/626 |
| 4,571,599 | | 2/1986 | Rezanka | 346/140 |
| 4,771,295 | | 9/1988 | Baker et al. | 346/1.1 |
| 4,947,192 | | 8/1990 | Hawkins et al. | 346/140 |
| 4,961,088 | | 10/1990 | Gilliland et al. | 355/206 |
| 4,970,533 | * | 11/1990 | Saito et al. | 347/7 |
| 5,010,355 | | 4/1991 | Hawkins et al. | 346/140 |
| 5,021,828 | | 6/1991 | Yamaguchi et al. | 355/209 |
| 5,185,614 | | 2/1993 | Courian et al. | 346/1.1 |
| 5,283,613 | | 2/1994 | Midgley | 355/203 |
| 5,365,312 | | 11/1994 | Hillmann et al. | 355/206 |
| 5,406,315 | * | 4/1995 | Allen et al. | 347/7 |
| 5,486,855 | | 1/1996 | Carlotta et al. | 347/87 |
| 5,528,269 | * | 6/1996 | Drogo et al. | 347/19 |
| 5,534,902 | | 7/1996 | Hoesly | 347/104 |
| 5,835,817 | * | 11/1998 | Bullock et al. | 347/19 |
| 5,929,885 | * | 7/1999 | Nakajima et al. | 347/7 |
| 6,019,449 | * | 2/2000 | Bullock et al. | 347/19 |
| 6,024,428 | * | 2/2000 | Uchikata | 347/19 |
| 6,106,088 | * | 8/2000 | Wafler | 347/19 |

FOREIGN PATENT DOCUMENTS

| | | | | |
|---|---|---|---|---|
| 0 720 916-A2 | * | 10/1996 | (EP) | B41J/2/175 |
| 9-29989-A | * | 2/1997 | (JP) | B41J/2/175 |

* cited by examiner

*Primary Examiner*—John Barlow
*Assistant Examiner*—Robert D Loper, Jr.
(74) *Attorney, Agent, or Firm*—Robert A. Chittam; David J. Arthur

(57) ABSTRACT

A color ink jet printer having a replaceable printhead assembly with a plurality of replaceable ink tanks, one ink tank for each color of ink, senses a patch on each ink tank. The presence of the patch indicates the ink tank is new. In one embodiment, the patch is adhered over a recess in each of the tanks and is punctured by a pin which is triggered as soon as the patch is detected, so that the patch cannot be detected again. The energization of each group of heating elements associated with a respective ink tank is counted and stored in the printer memory and, as each energization results in the ejection of an ink droplet of known volume, a predetermined number of energizations, which represent the volume of usable ink in each ink tank, is stored in the memory. When this predetermined number of energizations is reached, an out-of-ink display is shown to the user. If a new ink tank is detected before the ink in the previously installed ink tank is depleted, the printer controller resets the energization count to zero. In another embodiment, the patch is a bar code identifying each ink tank, so that if it is removed before being depleted of ink and re-installed after a different ink tank has been used, the count at the time of replacement is maintained in memory and the count is resumed when the ink tank is re-installed and the bar code is sensed.

6 Claims, 5 Drawing Sheets

PRINTHEAD ASSEMBLY WITH INK MONITORING SYSTEM

BACKGROUND OF THE INVENTION

The invention relates to ink jet printing devices and more particularly to ink jet printers using a replaceable printhead assembly with replaceable ink tanks and a monitoring system to record and display an out of ink condition for an ink tank depleted of ink. The monitoring system monitors the volume of ink remaining in the ink tank by accumulatively counting the droplets ejected and comparing the counted droplets to the predetermined number representative of the total ink volume in the ink tank. When an ink tank has been replaced before it has been depleted of ink by a new ink tank, the monitoring system detects the replacement and resets the accumulative droplet count to zero.

For the convenience of the users or customers of ink jet printers, customer replaceable printheads are used which may be removed and replaced by the customer when the printhead's design lifetime has expired. The customer replaceable printheads also use customer replaceable ink supply tanks or cartridges, and each printhead may deplete ink from many ink tanks before reaching the end of its design lifetime. For existing multicolor ink jet printheads, it is not uncommon for the printhead to deplete the ink from as many as ten ink tanks for each color of ink, for example, yellow, magenta, cyan, and black, before reaching the end of the printhead lifetime. It is known that the droplet-ejecting heating elements of thermal ink jet printheads have a lifetime determined by the number of times the heating elements are pulsed with an electrical signal and that a printer controller can determine the lifetime status of the printhead by accumulatively counting the number of times the heating elements are pulsed. It is also known that the ink volume remaining in the ink tanks can be determined by counting the number of ink droplets that have been ejected and replenished from a particular ink tank, because the volume of each ink droplet is substantially the same.

A problem of determining the available ink for a printhead is encountered when an ink tank is removed prior to ink depletion and a new ink tank installed, unless there is an optical low ink sensing system, which is expensive if not complex. In this situation, the printer counts the ink droplets until the predetermined number representing a depleted ink tank is reached and the printer thinks the ink tank is empty when in fact the ink tank still has usable ink. To prevent printhead damage caused by energizing heating elements in channels without ink, the printer controller stops the printer from printing until a new ink tank replaces the ink tank that the printer thinks is empty. Therefore, an ink tank with some ink still therein, must be removed and replaced by a new ink tank. This invention is directed to a cost effective way for the printer controller to monitor and keep track of the amount of ink remaining in the ink tank presently installed in the printer.

U.S. Pat. No. 4,961,088-A discloses a system for monitoring customer replaceable cartridges in printers or copiers. Each replaceable cartridge includes an electrically erasable programmable read only memory (EEPROM) which is programmed with a cartridge identification number that when matched a cartridge identification number in the printer or copier enables the printer or copier to operate, provides a cartridge replacement warning count, and provides a termination count at which the cartridge is disabled from further use. The EEPROM is programmed to store updated counts of the remaining number of images or prints available by the cartridge after each print or copy is made by the printer or copier.

U.S. Pat. No. 5,021,828-A discloses a replaceable unit for use in a copier or printer in which initial use and near-end-of-life is recorded by electrical means, including a portion itself removable from the removable, comprising two fuses. A first fuse is blown when a few copies have been made with the replaceable unit, and the second fuse is used to prevent further use of the replaceable unit when a certain number of copies or prints have been made with the replaceable unit.

U.S. 5,283,613-A discloses a monitoring system for replaceable cartridges in a printer or copier, including an electronic count memory and an electronic flag memory. The count memory maintains a one-by-one count of prints made with the cartridge. The flag memory includes a series of bits which are alterable from a first state to a second state but not alterable from the second state to the first state. The bits in the flag memory are altered at predetermined intervals as prints are made with the cartridge. The flag memory is used as a check to override unauthorized manipulation of the count memory.

U.S. 5,365,312-A discloses replaceable ink reservoirs, ribbon cassettes, or toner cartridges having an electronic memory means in the form of a chip in which information is stored about the current fill status of the reservoir and other status data that are relevant for printer operation. The used status of the ink or other printing medium is acquired from the controller of the printing machine and is communicated to the chip. The chip on the reservoirs counts consumption until the supply is exhausted to such an extent the reservoir must be replaced. A reprogramming of the chip and refilling of the reservoir is not possible.

U.S. Ser. No. 08/941,910 filed Oct. 1, 1997 and entitled "Printhead Assembly With Integral Lifetime Monitoring System" to Walter F. Wafler discloses an ink jet printer having a customer replaceable printhead assembly with a usage monitoring system which detects and displays the remaining available use or lifetime for the printhead assembly installed in the printer. The droplet ejecting electrical pulses applied to selected heating elements of the printhead in the printhead assembly are counted and compared with the number of pulses assigned to a set of permanently inactivable or changeable cell sites integral with the printhead assembly. Each time the number of counted pulses are equal to the value assigned for a cell site, the cell site is addressed to change its state from active to inactive. The remaining active cell sites are representative of the percent of remaining available use for the installed printhead assembly, and this percentage is displayed for the convenience of the customer. Because the cell sites are permanently changed, the supplier can also determine the amount of use of the printhead assembly when warranty claims are submitted.

SUMMARY OF THE INVENTION

It is an object of the present invention to monitor the available ink in a replaceable ink supply tank for an ink jet printer by accumulatively counting ejected ink droplets which are replenished therefrom and detect the replacement of an ink tank prior to depletion of the ink therein. If the same ink supply tank is installed, the count continues, if a new ink supply tank is installed the count is reset to zero and the new tank is identified as no longer a new tank.

In one aspect of the invention, there is provided a color ink jet printer having a replaceable printhead assembly with a plurality of replaceable ink tanks mounted on a movable carriage for reciprocation of the printhead assembly along a path across and parallel to a confronting printing medium, each ink tank containing a different color of ink therein, and means for monitoring the amount of ink in the ink tanks, comprising: a replaceable printhead assembly having a printhead with a plurality of groups of nozzles, each nozzle in each group being in fluid communication with an associated reservoir for that group of nozzles by a separate ink channel, each reservoir connecting to a replaceable ink tank installed on said printhead assembly, each ink channel having a heating element located therein adjacent the nozzle for the respective ink channel; means for selectively energizing each heating element, each energization of a heating element ejecting an ink droplet having a predetermined volume of ink, so that each energization of the heating element represents the volume of one ink droplet; a printer controller having a memory for storing a number of heating element energizations which represent the volume of ink contained in each ink tank; means for counting and accumulatively storing the number of energizations of each group of heating elements associated with a respective one of the ink tanks in the memory; and means for sensing and determining whether an installed ink tank has been replaced prior to depletion of the ink therein.

BRIEF DESCRIPTION OF THE DRAWINGS

The present invention will now be described by way of example with reference to the accompanying drawings, wherein like reference numerals refer to like elements and in which.

DESCRIPTION OF THE PREFERRED EMBODIMENT

Figure 1:
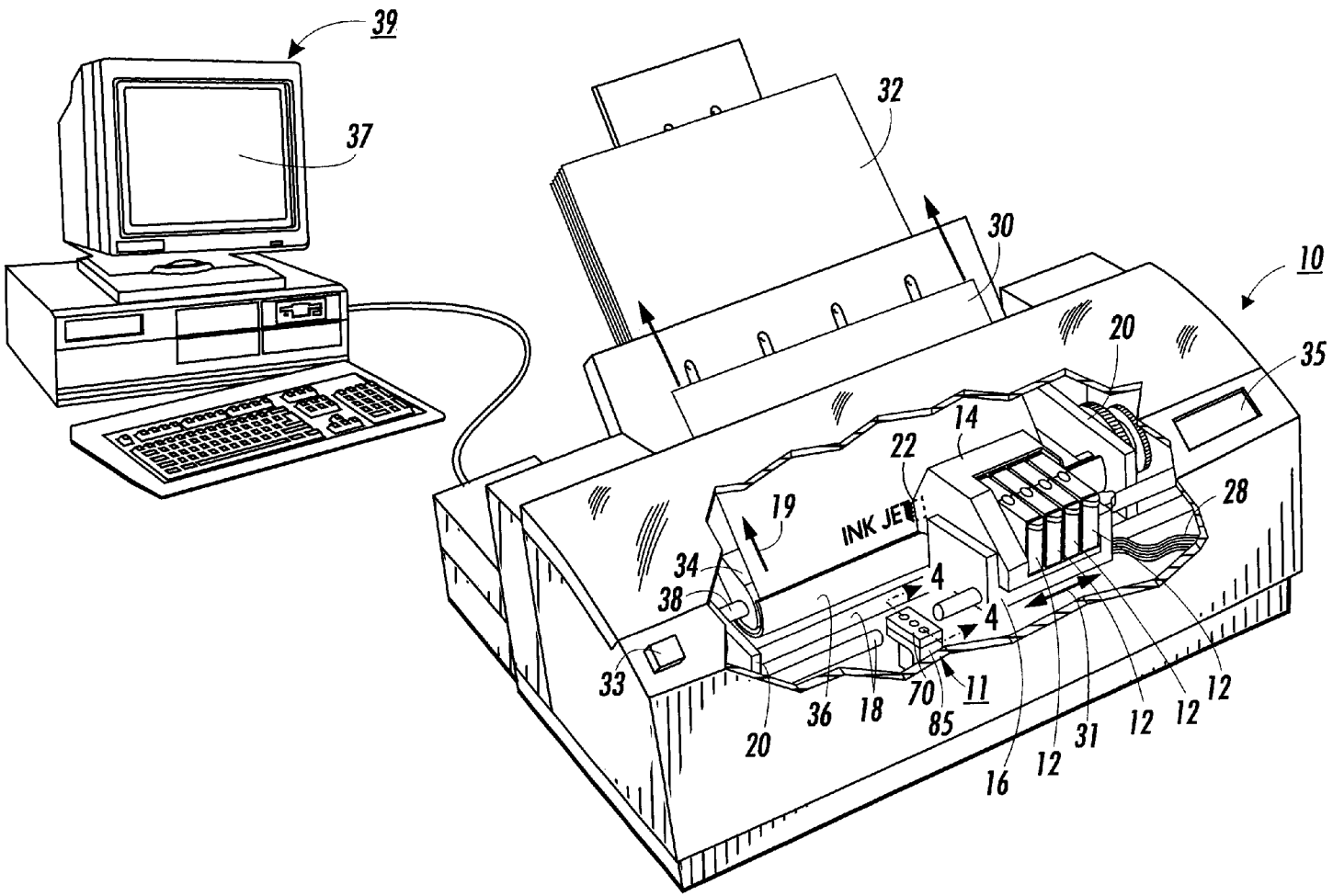
FIG. 1 is an isometric view of a carriage type multicolor ink jet printer having a customer replaceable printhead assembly and separate customer replaceable ink supply tanks which incorporate the ink monitoring system of the present invention.
Figure 2:
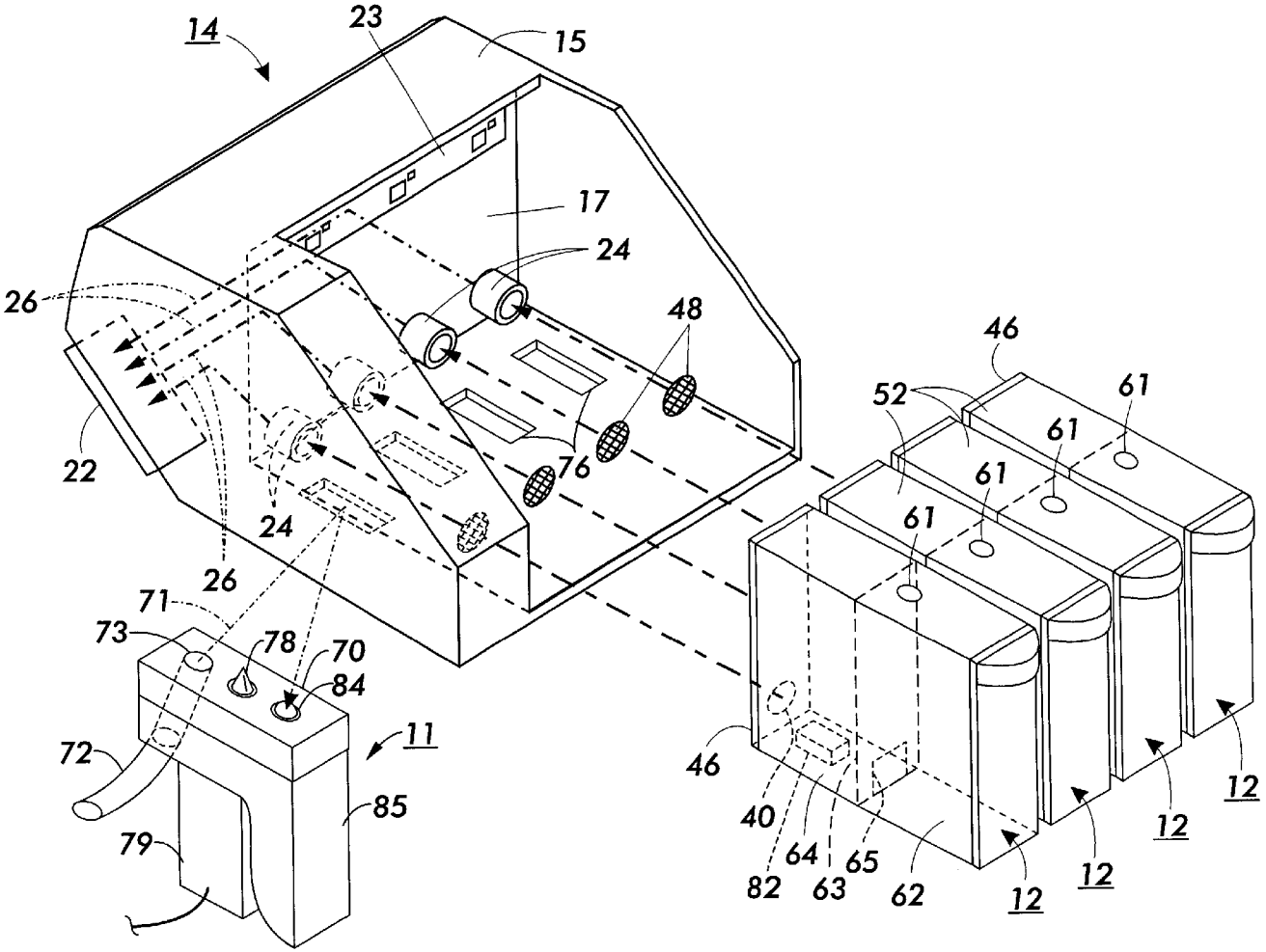
FIG. 2 is a partially exploded isometric view of the customer replaceable printhead assembly and ink tanks shown in FIG. 1.

FIG. 1 illustrates an isometric view of a carriage type, multicolor thermal ink jet printer 10 having an electronic monitoring system for the customer replaceable printhead assembly 14 and the ink monitoring system 11 of the present invention. The printer is connected to personal computer 39 having a monitor 37 from which data is generated and directed to the printer for hard copies thereof. The printhead assembly includes four customer replaceable ink supply tanks 12 mounted therein. The ink supply tanks may each have a different color of ink, and in the preferred embodiment, the tanks have yellow, magenta, cyan, and black ink. The printhead assembly is installed on a translatable carriage 16 which is supported by carriage guide rails 18 fixedly mounted in frame 20 of the printer. The carriage is translated back and forth along the guide rails by any suitable means (not shown), such as, for example, a timing belt driven by an electrical motor, as is well known in the printer industry. The carriage is under the control of the printer controller 21, shown in FIG. 3. The printing operation by the printer may be initiated from the personal computer or the print start button 33 on the printer. Printer operational status and printing instructions may be obtained from the monitor 37 or the display panel 35 on the printer. Referring also to FIG. 2, the sensing station 11 is located beneath the guide rails 18 and comprises a sensor board 70 which is penetrated by an optical fiber 72, though any light transmissive optical channel may be used. One end of the optical fiber is coupled to a light source (not shown) and the other free end 73 is substantially coplanar with the sensor board and directs a beam of light 71 (FIG. 4) at an angle $\Theta$ with respect to a line normal to the surface of the sensor board and towards the path of the carriage. In the embodiment shown, the beam of light 71 is directed between the guide rails 18, through openings 74 in the carriage and openings 76 in the printhead assembly housing 15 and onto a reflective foil patch 80 covering a recess 82 in each of the ink tanks 12, as described more fully later. If the foil patch 80 has not been punctured, the beam of light 71 is reflected back to a photodetector or photodiode 84 mounted on the sensor board 70. The photodetector or photodiode is coupled to well known circuitry (not shown) which is connected to the printer controller, so that any signal generated by the photodetector is sent to the controller and this signal identifies a new ink supply tank.

Figure 3:
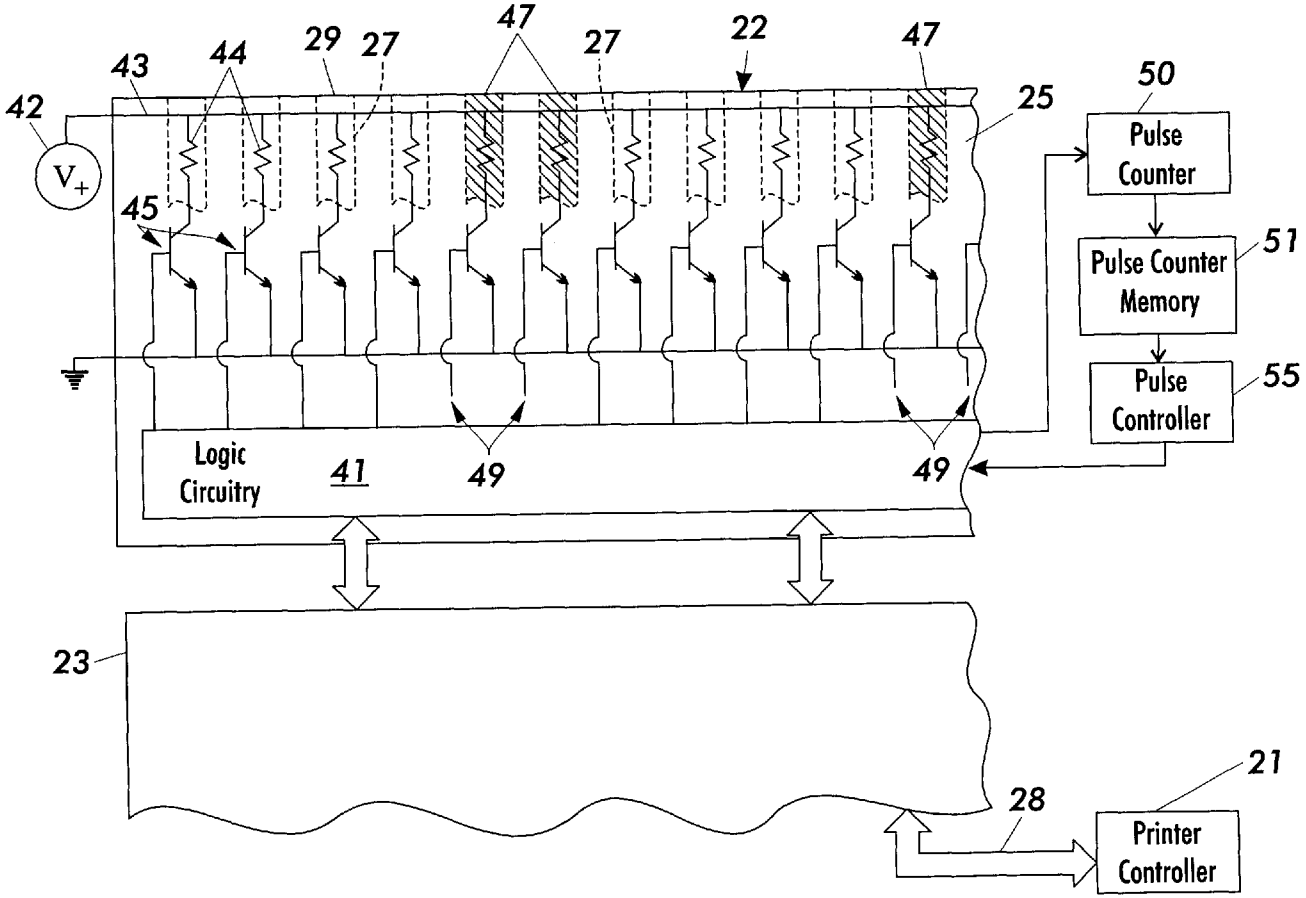
FIG. 3 is a partially shown plan view of an electrical diagram of an ink jet printer having the ink monitoring system of the present invention.
Figure 4:
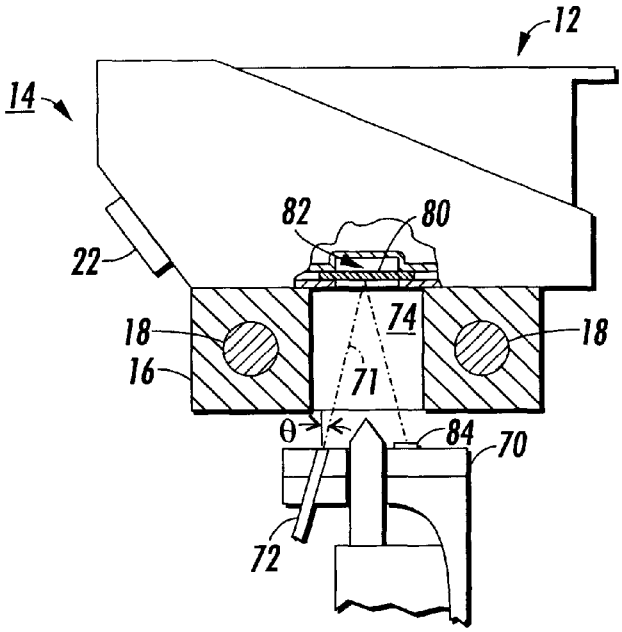
FIG. 4 is a partially shown cross-sectional view of the reflective sensor of the present invention as viewed along view line 4—4 in FIG. 1.
Figure 5:
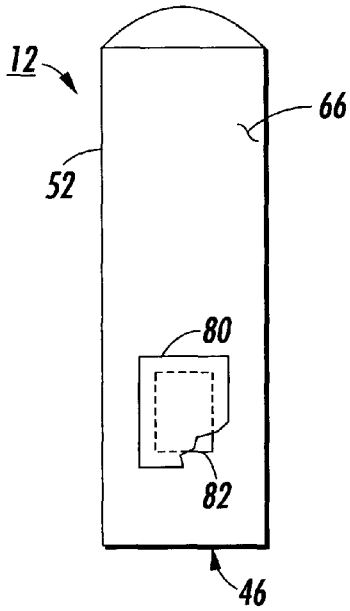
FIG. 5 is an end view of an ink tank showing a partially removed portion of the reflective material covering a recess in the ink tank.
Figure 6:
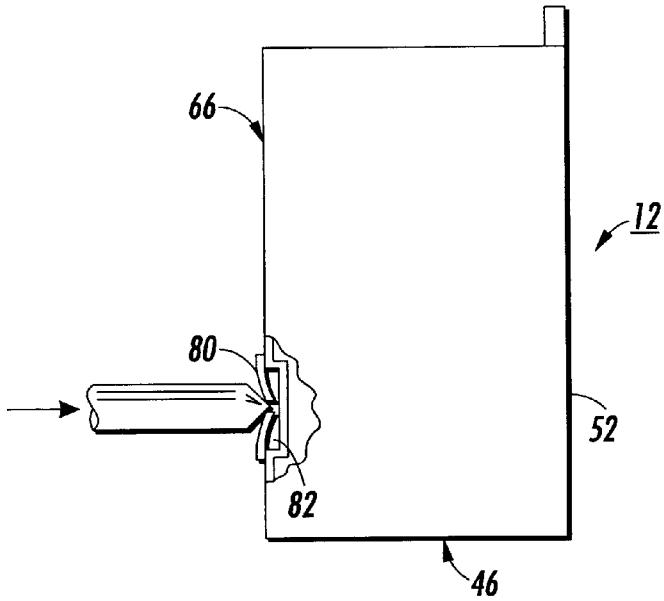
FIG. 6 is a partially sectioned side elevation view of an ink tank showing the movable pin of FIG. 4 puncturing the reflective material over the ink tank recess.

With continued reference to FIG. 2, the printhead assembly 14 comprises a housing 15 having an integral multicolor ink jet printhead 22 and ink pipe connectors 24 which protrude from a floor 17 of the printhead assembly for insertion into the outlet ports 40 of the ink supply tanks 12 when the ink supply tanks are installed in the printhead assembly housing. The protruding ink pipe connectors are usually covered by a wire mesh filter 48 to prevent particles or debris from the ink supply tanks from being carried by the ink into the printhead. Ink flow paths, represented by dashed lines 26, in the housing interconnects each of the ink pipe connectors with the separate inlets (not shown) of the printhead, one inlet for each color. The printhead assembly on which the replaceable ink supply tanks are mounted, includes an interfacing printed circuit board 23 that is connected to the printer controller 21 by ribbon cable 28 (FIG. 1) through which electric signals are selectively applied to the printhead to selectively eject ink droplets from the printhead nozzles 29 (FIG. 3). The printed circuit board 23 also detects that an ink tank is installed and prevents operation of the printer if an ink tank is missing. The multicolor printhead 22 contains a plurality of ink channels 27 with heating elements 44 (see FIG. 3) which carry ink from each of the ink supply tanks to respective groups of ink ejecting nozzles of the printhead.

When printing, the carriage 16 reciprocates back and forth along the guide rails 18 in the direction of arrow 31. As the printhead 22 reciprocates back and forth across a recording medium 30, such as single cut sheets of paper fed from an input stack 32 of sheets, droplets of ink are expelled from selected ones of the printhead nozzles towards the recording medium 30. The nozzles are typically arranged in a linear array perpendicular to the reciprocating direction of arrow 31. During each pass of the carriage 16, the recording medium 30 is held in a stationary position. At the end of each pass, the recording medium is stepped in the direction of arrow 19 for a distance equal to the height of a printed swath. For a more detailed explanation of the printhead and the printing thereby, refer to U.S. Pat. No. 4,571,599-A and U.S. Pat. No. Re 32,572-E, the relevant portions of which are incorporated herein by reference.

A single sheet of recording medium 30 is fed from the input stack 32 through the printer along a path defined by a curved platen 34 and a guide member 36. The sheet is driven along the path by a transport roller 38 as is understood by those skilled in the art or, for instance, as illustrated in U.S. Pat. No. 5,534,902-A, incorporated herein by reference. As the recording medium exits a slot between the platen 34 and guide member 36, the sheet 30 is caused to reverse bow such that the sheet is supported by the platen 34 at a flat portion thereof for printing by the printhead 22.

With continued reference to FIG. 2, ink from each of the ink supply tanks 12 is drawn by capillary action through the outlet port 40 in the ink supply tanks, the ink pipe connectors 24 which extend through the outlet port 40, and ink flow paths 26 in the printhead assembly housing to the printhead 22. The ink pipe connectors and the flow paths of the housing thus supply ink to the ink channels of the printhead, capillarily replenishing the ink after each ink droplet ejection from the nozzle associated with the printhead ink channel. It is important that the ink at the nozzles be maintained at a slightly negative pressure, so that the ink is prevented from dripping onto the recording medium 30, and ensuring that ink droplets are placed on the recording medium only when a droplet is ejected by an electrical signal applied to the heating element in the ink channel for the selected nozzle. A negative pressure also ensures that the size of the ink droplets ejected from the nozzles remain substantially constant as ink is depleted from the ink supply tanks. The negative pressure is usually in the range of −0.5 to −2.0 inches of water. One known method of supplying ink at a negative pressure is to place within the ink supply tanks an open cell foam or needled felt (not shown) in which ink is absorbed and suspended by capillary action. Ink tanks which contain ink holding material are disclosed, for example, in U.S. Pat. Nos. 5,185,614-A, 4,771,295-A and 5,486,855-A.

The ink supply tanks 12 for a carriage type ink jet printer 10 comprises a housing 52 of any suitable material, such as, for example, polypropylene, having first and second compartments 62, 64 which are separated by a common wall 63. Ink is stored in the first compartment 62 after introduction therein through ink inlet 61 which is subsequently covered. The second compartment 64 has an open cell foam member (not shown) inserted therein. Ink from the first compartment moves through aperture 65 in the common wall 63 to saturate the foam member with ink. The foam member is inserted into the second compartment through the open bottom thereof, and then the open bottom is covered by a bottom wall 46 of the same material as the housing 52. The bottom wall 46 has the open outlet port 40 and is heat staked to weld it to the housing 52 after the foam member is inserted. One end wall 66 of the ink tank housing 52 contains the recess 82 which is covered by a reflective foil patch 80. When each of the ink tanks 12 is installed in the printhead assembly 14, the foil patch covered recess 82 of each ink tank is aligned over the openings 76 in the printhead assembly housing 15. The replaceable printhead assembly openings 76 are aligned with the openings 74 in the carriage 16, when the printhead assembly 14 is mounted on the carriage. As the carriage 16 reciprocates along the guide rails 18, the carriage travels over the location of the sensor board 70 and light beams 71 are directed onto each of the foil patches 80 through the openings in the carriage and printhead assembly and reflected back to the photodetector or photodiode 84. When the photodetector receives light, it generates a signal and sends it to the printer controller 21 by well known circuitry (not shown).

Also located in the sensor board 70, is a movable pin 78 which is moved towards and through the foil patch 80 by a solenoid 79 to puncture the foil patch, so that it will not reflect the light beams 71 as the carriage subsequently travels past the sensor board. The pin could be actuated by any suitable means and could be located any convenient place along the traverse of the carriage, such as, for example, at a maintenance station. However, in the preferred embodiment it is located in the sensor board 70, which is mounted on a bracket 85 fixedly attached to the printer. The puncturing of the foil patch identifies the ink tank as no longer a new ink tank.

Referring to FIG. 3, a partially shown electrical diagram for the customer replaceable ink jet printhead assembly 14 of the printer in FIG. 1 is depicted. The printhead assembly includes printhead 22 which is similar to the printheads described in U.S. Pat. Nos. 4,947,192-A and 5,010,355-A, both of which patents are incorporated herein by reference. The heating elements 44, such as described in these two incorporated patents, are located on a silicon substrate 25 of the printhead in capillarily filled ink channels 27 (partially shown in dashed line) a predetermined distance upstream from the channel open ends 29 which serve as the droplet ejecting nozzles. The predetermined distance is about 50 to 100 $\mu$m. The common return 43 is formed on the silicon substrate in the region between the nozzles and the heating elements. A voltage of 40 to 60 volts from voltage source 42 is applied to the common return. The heating elements 44 are connected to the common return and driver transistors 45. The heating elements are pulsed with this voltage on the common return through the driver transistors 45 which are in turn connected to the printhead logic circuitry 41. The transistor drains are connected to the heating elements, the transistor gates are connected to the logic circuitry, and the transistor sources are connected to ground. Input data received by the printer controller or microprocessor 21 is processed thereby and, in response thereto, the heating elements are selectively pulsed to eject ink droplets by the driver transistors 45 via the printer controller 21, ribbon cable 28, circuit board 23, and logic circuitry 41 integrally formed on the printhead.

A typical multicolor printhead 22 for a carriage type printer 10 has a linear array of nozzles which are spaced from 300 to 600 per inch or more, In one embodiment, there are 128 nozzles which are grouped 48 for black ink and 24 each for yellow, magenta, and cyan. There are four inactive nozzles between the nozzles for black ink and the adjacent nozzles for the next color ink, and there are two inactive nozzles between each of the nozzles for non-black inks. In FIG. 3, only a few representative nozzles 29 of the 128 nozzles are shown, with the inactive nozzles 47 and associated channels 44 being shown as cross hatched and with their associated driver transistors having their gates not connected to the logic circuitry, as indicated at 49.

When the printhead is printing, a pulse counter 50 is accumulatively counting the pulses applied to each of the heating elements. The number of pulse counts for each heating element is stored in the pulse count memory 51, which is typically a random access memory (RAM). The number of pulses (L) per heating element which has been determined to represent the lifetime thereof is typically about $1\times10^9$ pulses. During each printing operation, the number (P) of printing pulses applied to the selected heating elements is counted and stored in the pulse count memory. The stored pulse count P is continually compared to the number of pulses L by the pulse controller 55. If the printing pulses P is less than the number L, the printing pulses are retained in storage for continued accumulative summing with subsequent or continuing printing operations and continued or periodic comparing with the number L. When the printing pulses P are equal to L for any one of the selected heating elements, the pulse controller signals the printer controller and the printer controller displays on the printer display panel 35 or monitor 37 shown in FIG. 1 "order new printhead assembly", and when a predetermined number of pulses are counted above the number L, the printer is disabled until a new printhead assembly is installed.

In addition, the total number of pulses T for each group of heating elements which eject ink droplets of the same color of ink is counted by the pulse counter 50 and stored in the pulse count memory 51. Because the ink droplets have substantially the same volume of ink, about 40 picoliters, the number of droplets Q which are equal to the usable ink in each ink tank, the Q number is stored in the memory 51 and the number T is continually compared to the number Q. When T is equal to Q, the pulse controller 55 signals the printer controller 21 which causes the display panel 35 or monitor 37 to display "out of ink" for the particular ink tank. When a predetermined number of pulses T exceed the number Q, the printer is disabled until a new ink tank is installed.

Figure 7:
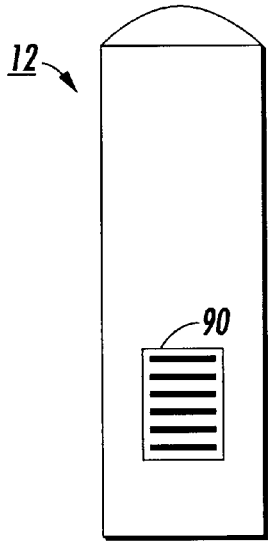
FIG. 7 is an end view of an ink tank showing an alternate embodiment of the present invention.

In the embodiment wherein the ink tanks have the reflective foil patch 80, the ink tanks may be removed and re-installed and the accumulative count of pulses are retained in memory and the counting resumes with the T pulses last stored in memory 51. However, if an ink tank is removed prior to being depleted of ink and a new tank is installed, the foil patch will be detected by the ink monitoring system 11 and the pulse count stored in memory 51 will be reset to zero. A problem is encountered, if a different partially depleted ink tank is installed because it could have more or less ink than the one removed, and the count would be continued as if it were the original partially depleted ink tank. To overcome this scenario, a patch 90 with a bar code identifying each particular ink tank as shown in FIG. 7 replaces the foil patch over a recess that is read by a modified ink monitoring system 11 which stores in the pulse count memory 51 but the pulse counting is done per bar code read. In this way, a partially used ink tank could replace a partially depleted ink tank and the pulse counting would remain accurate.

Accordingly, the user or customer always knows when to replace the printhead assembly 14 and when to replace an ink tank with a new one.

Although the foregoing description illustrates the preferred embodiment, other variations are possible and all such variations as will be obvious to one skilled in the art are intended to be included within the scope of this invention as defined by the following claims.

What is claimed is:

1. A color ink jet printer having a replaceable printhead assembly with a plurality of replaceable ink tanks mounted on a movable carriage for reciprocation of the printhead assembly along a path across and parallel to a confronting printing medium, each ink tank containing a different color of ink therein, and means for monitoring the amount of ink in the ink tanks, comprising:

a replaceable printhead assembly having a printhead with a plurality of groups of nozzles, each nozzle in each group being in fluid communication with an associated reservoir for that group of nozzles by a separate ink channel, each reservoir connecting to a replaceable ink tank installed on said printhead assembly, each ink channel having a heating element located therein adjacent the nozzle for the respective ink channel;

means for selectively energizing each heating element, each energization of a heating element ejecting an ink droplet having a predetermined volume of ink, so that each energization of the heating element represents the volume of one ink droplet;

a printer controller having a memory for storing a number of heating element energizations which represent the volume of ink contained in each ink tank;

means for counting and accumulatively storing the number of energizations of each group of heating elements associated with a respective one of the ink tanks in the memory; and means for sensing and determining whether an installed ink tank has been replaced prior to depletion of the ink therein, wherein the means for sensing and determining is a sensor station positioned adjacent said path of said carriage for detecting a patch on each ink tank.

2. The printer as claimed in claim 1, wherein the sensor station comprises a reflective sensor having a source of light for directing light towards said carriage path, so that the light impinges on the patches of the ink, tanks as the carriage passes said light, and a photodetector positioned to detect light reflected from each of said patches, any reflected light detected by said photodetector being indicative of a new replaceable ink tank installed on the printhead assembly.

3. The printer as claimed in claim 2, wherein the printer further comprises a recess in each ink tank that is covered by a one of said patches; and wherein the printer further comprises a mechanism capable of selectively altering said patches, so that subsequent sensing by the reflective sensor will not detect a patch confirming that the ink tank installed on the printhead assembly is not a new ink tank.

4. The printer as claimed in claim 2, wherein the printer further comprises a recess in each ink tank that is covered by a one of said patches; and wherein a movable pin for puncturing the patch detected by said photodetector, so that subsequent sensing by the reflective sensor will not detect a patch confirming that the ink tank installed on the printhead assembly is not a new ink tank.

5. The printer as claimed in claim 4, wherein the printer further comprises a display panel and means for displaying an out-of-ink display on said panel when the number of energizations of the group of heating elements associated with a respective ink tank has been reached and the reflective sensor did not detect a new tank.

6. The printer as claimed in claim 5, wherein the means for counting and accumulatively storing the number of energizations of each group of heating elements associated with its respective ink tank resets the stored number of energizations to zero when a new tank is detected prior to being depleted of ink.

* * * * *